United States Patent [19]

Lovell et al.

[11] Patent Number: 4,971,374

[45] Date of Patent: Nov. 20, 1990

[54] HOME SECURITY PROTECTION KIT

[76] Inventors: Herman E. Lovell, 3614 Valley Vista Rd., Nashville, Tenn. 37205; Randle Richardson, 405 Huntington Ridge Dr., Nashville, Tenn. 37211

[21] Appl. No.: 318,632

[22] Filed: Mar. 3, 1989

[51] Int. Cl.[5] ..... E05C 19/18

[52] U.S. Cl. ..... 292/339; 292/DIG. 46; 292/262; 292/288; 292/258; 292/300; 206/231

[58] Field of Search ..... 292/300, DIG. 46, 338, 292/339, 262, DIG. 15, 288, 258; 206/223, 576, 230, 231; 49/404

[56] References Cited

U.S. PATENT DOCUMENTS

| | | | |
|---|---|---|---|
| Re. 27,161 | 8/1971 | Raymon | 49/449 |
| D. 219,362 | 12/1970 | Snyder | D8/203 |
| D. 225,152 | 11/1972 | Robins | D8/150 |
| D. 255,212 | 6/1980 | Weigand et al. | 292/339 |
| D. 293,091 | 12/1987 | Phillips | D10/116 |
| 1,625,547 | 4/1927 | Kessler | 206/231 X |
| 2,622,190 | 11/1971 | Mohun | 49/450 |
| 2,639,454 | 5/1953 | Dory | 206/577 X |
| 3,071,957 | 1/1963 | Golub | 70/90 |
| 3,428,349 | 2/1969 | Shelton | 292/288 |
| 3,469,823 | 9/1969 | Blum et al. | 403/377 X |
| 3,471,189 | 10/1969 | Ness | 292/266 |
| 3,640,559 | 2/1972 | Royer | 292/288 |
| 3,714,738 | 2/1973 | Koslow et al. | 49/404 |
| 3,756,641 | 9/1973 | Dugan | 292/251 |
| 3,807,779 | 4/1974 | Enders | 292/147 |
| 3,816,967 | 6/1974 | Littrell | 49/449 |
| 3,820,285 | 6/1974 | Shiffler et al. | 49/450 |
| 3,863,470 | 2/1975 | Imer | 70/100 |
| 3,975,041 | 8/1976 | Edison | 292/258 |
| 3,993,336 | 11/1976 | Frost | 292/263 |
| 4,019,765 | 4/1977 | Nichola | 248/354.5 |
| 4,054,308 | 10/1977 | Prohaska | 292/204 |
| 4,068,506 | 1/1978 | Phelps | 70/100 |
| 4,073,522 | 2/1978 | Tierney | 292/262 |
| 4,084,290 | 4/1978 | Lymar et al. | 16/96 R |
| 4,148,508 | 4/1979 | Adair | 292/258 |
| 4,231,599 | 11/1980 | Gayman | 292/339 |
| 4,268,074 | 5/1981 | Alexander | 292/3 |
| 4,278,280 | 7/1981 | Rashbaum | 292/338 X |
| 4,304,429 | 12/1981 | Gist | 292/258 |
| 4,350,377 | 9/1982 | McCarthy | 292/288 |
| 4,351,170 | 9/1982 | Clompus | 70/90 |
| 4,379,576 | 4/1983 | Blough et al. | 292/300 X |
| 4,400,027 | 8/1983 | Nahon | 292/288 |
| 4,438,640 | 3/1984 | Willis | 70/94 |
| 4,456,291 | 6/1984 | Brogie | 292/338 |
| 4,512,600 | 4/1985 | King | 292/338 |
| 4,526,412 | 7/1985 | Gist | 292/258 |
| 4,563,027 | 1/1986 | Chechovsky et al. | 292/339 |
| 4,630,853 | 12/1986 | Bell | 292/258 |
| 4,639,022 | 1/1987 | Dunphy et al. | 292/150 |
| 4,792,168 | 12/1988 | Kardosh | 292/339 X |

*Primary Examiner*—Richard E. Moore

*Attorney, Agent, or Firm*—Fleit, Jacobson, Cohn, Price, Holman & Stern

[57] ABSTRACT

The combination of lock assisting devices forming the home security protection kit of the present invention was determined as a result of extensive effort to determine the appropriate product mix to help secure an apartment, condominium, or small home, based upon visiting many apartments, condominium developments, and neighborhoods where small homes are located. These visits resulted in taking inventory of the number of hinged doors, sliding glass doors, ground level windows, and other design features that were in need of some type of auxiliary security device. Based upon this research, it was determined that a product mix of four metal window clamps, four window pins for wood sash windows, one patio door clamp for a sliding glass door, four anti-liftout plates of two different thicknesses for sliding glass doors, and two door braces satisfied the requirements of securing a condominium, apartment, or small home. Therefore, the contents of the kit of the present invention will secure a majority of dwellings.

12 Claims, 4 Drawing Sheets

HOME SECURITY PROTECTION KIT

1. Field of the Invention

This invention relates to a combination of home security devices in a home security protection kit to prevent an intruder from entering an apartment, condominium, or small home.

2. Background of the Invention

Home security has become an ever-increasing factor in the minds of apartment, condominium, and home dwellers. It is imperative that people be afforded the opportunity to feel secure in their own homes. Most hardware stores, department stores, and even some grocery stores now commonly stock some sort of security devices for purchase and installation by the individual consumer. The availability of different types of locks and securing devices is endless, and there is no recommended product mix to secure the entryways typically found in an apartment, condominium, or small home.

SUMMARY OF THE INVENTION

The combination of lock assisting devices forming the home security protection kit of the present invention was arrived at as a result of extensive effort to determine the appropriate product mix to help secure an apartment, condominium, or small home, based upon visiting many apartments, condominium developments, and neighborhoods where small homes are located. These visits resulted in taking inventory of the number of hinged doors, sliding glass doors, ground level windows, and other design features that were in need of some type of auxiliary security device. Based upon this research, it was determined that a product mix of four metal window clamps, four window pins for wood sash windows, one patio door clamp for a sliding glass door or a metal frame window, four anti-liftout plates of two different thicknesses for sliding glass doors, and two door braces satisfied the requirements of securing a condominium, apartment, or small home. Therefore, the contents of the kit of the present invention will secure a majority of dwellings.

After studying numerous windows of both metal and wood construction, it was determined that the best device to address the issue of window security was to include four single screw metal window clamps and four metal window pins for wood sash windows. A majority of homes inspected included a front and rear door, and thus two door braces were required. At least one sliding glass door was usually found in most condominiums and apartments, and sometimes two sliding glass doors were found in small homes, thus necessitating inclusion of a double-screw metal patio door clamp and anti-liftout plates.

The home protection kit of the present invention provides effective protection against intruders while a person is at home. Various lock assisting devices are used to help prevent unwanted entry. These devices are secondary locking elements that help secure doors, windows, and sliding glass doors. The product mix included is universal in its protection of apartments, condominiums, and smaller homes, whether including one or all of swinging doors, windows (metal frame or wood sash), and patio doors.

In contrast to some types of security systems which activate an alarm based on an electronic system to make noise when an intruder actually enters the home, the home protection kit of the present invention is focused on preventing any entry into the home by an intruder while a person is at home.

It is an object of the present invention to provide a home protection kit including secondary lock assists.

It is yet another object of the present invention to provide a home protection kit including metal window clamps, window pins, a patio door clamp, anti-liftout plates, and door braces.

It is a further object of the present invention to provide a home protection kit having four metal window clamps, four window pins for wood sash windows, one patio door clamp for a sliding glass door or a metal frame window, four anti-liftout plates for sliding glass doors, and two door braces.

It is another object of the present invention to provide a home protection kit including a door brace which is usable for either of a hinged door or after removal of two end caps for use in blocking a track of a patio door.

It is still yet another object of the present invention to provide a home protection kit having metal window clamps, window pins for wood sash windows, a patio door clamp for a sliding glass door or metal frame window, anti-liftout plates for sliding glass doors, and door braces which are usable with either a hinged door or upon removal of two end caps for use in blocking a track of a sliding glass door.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
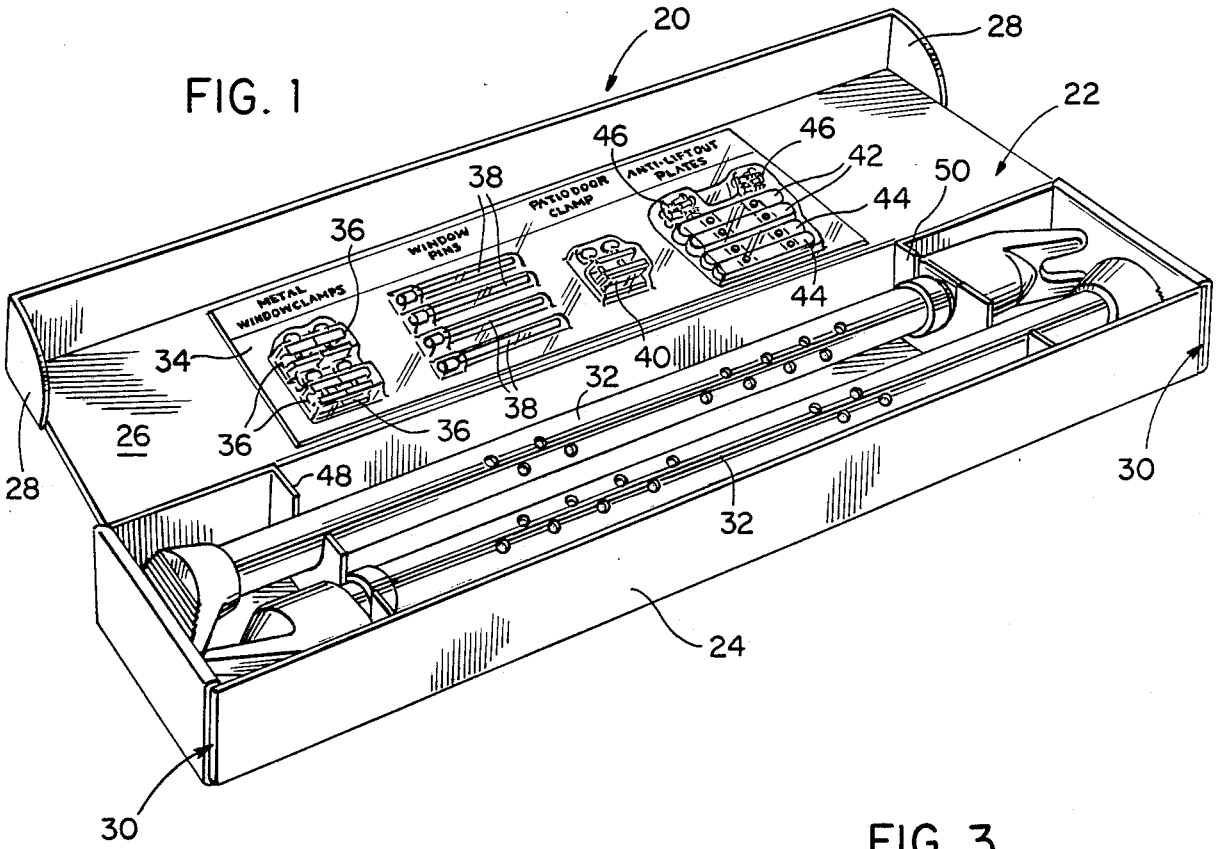
FIG. 1 illustrates the home protection kit of the invention in its form.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings in general, and to FIG. 1 in particular, a home security protection kit embodying the teachings of the subject invention is generally designated as 20. Kit 20 includes a cardboard box 22 having a rectangular base portion 24 and a foldable lid 26. The lid is swingable so as to have two end tabs 28 located on opposite sides of the lid fit within respective openings 30 to seal the box when the lid 26 is swung over the base portion 24.

Shown located in the base portion 24 are two door braces 32. The braces are shown in a collapsed condition for purposes of storage and shipping. Resting on top of the lid 26 is a cardboard backing sheet 34, which includes a series of lock-assisting devices secured to the back of cardboard backing sheet 34 by blister packing. Specifically, and as labelled on the top edge of the cardboard backing sheet 34, are four metal window clamps 36, four window pins 38 for wood sash windows, one patio door clamp 40 for a sliding glass door or a metal frame window, and four anti-liftout plates, including two plates 42 which are of a thickness twice as great as the remaining two anti-liftout plates 44. In addition, a series of mounting screws 46 are secured in the blister pack with the anti-liftout plates 42 and 44.

Normally, the cardboard backing sheet 34 is located in the space between the cardboard supports 48 and 50 which support the door braces in the box base portion 24. The cardboard backing sheet 34 rests on the tubular portions of the door braces so that the lid 26 may be pivoted and tabs 28 engaged in openings 30 to seal the box 22.

Figure 2:
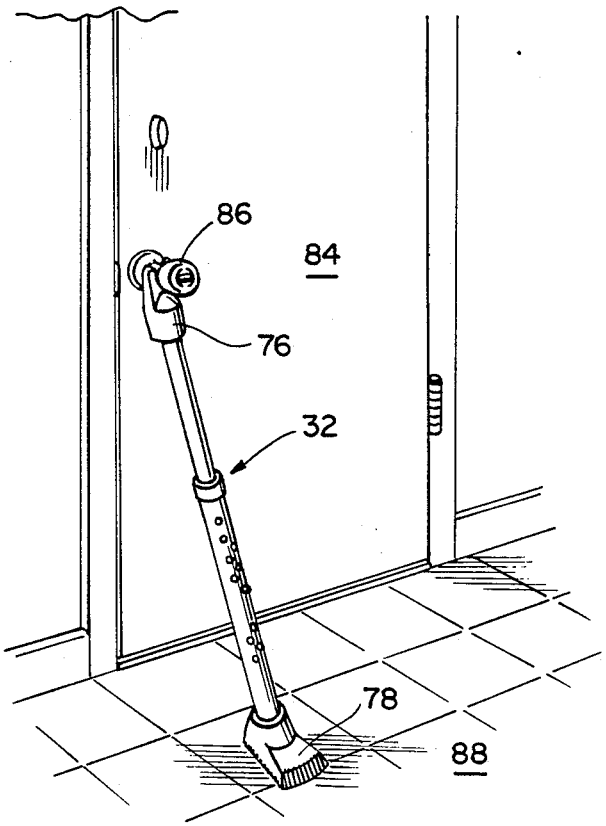
FIG. 2 illustrates a door brace locking a swinging door.
Figure 3:
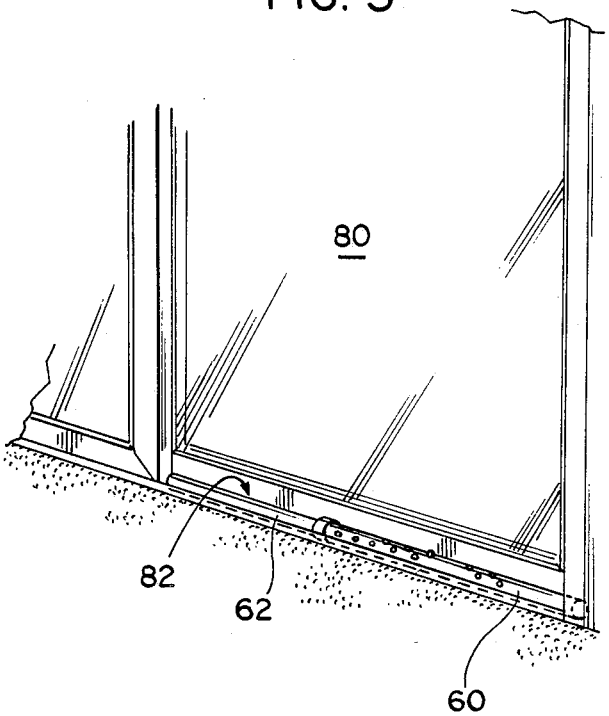
FIG. 3 illustrates the door brace of FIG. 2 without its end caps located in a track of a sliding glass door.
Figure 4:
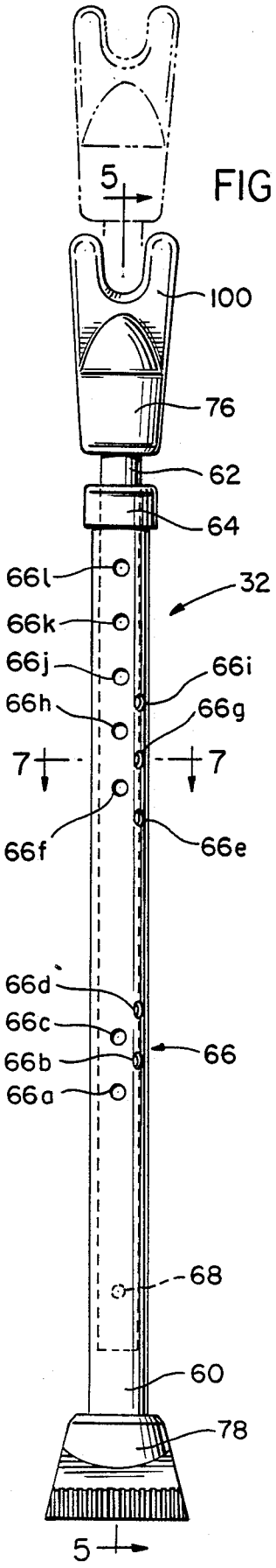
FIG. 4 is a front view of the door brace shown in FIG. 2.

In FIGS. 2–7, the details and uses of the door brace 32 are shown. FIG. 4 illustrates the door brace 32 with cylindrical outer tube 60 surrounding cylindrical inner tube 62. A plastic (PVC) control cuff or connector cuff 64 is mounted on one end of the outer tube 60. The internal diameter of the control cuff 64 is equal to the outer diameter of inner tube 62 to provide for smooth sliding of inner tube 62 within outer tube 64. Since there is such a close fit between the connector cuff and inner tube 62, the inner tube slides smoothly within outer tube 60 without wobbling. Play between the two tubes 60 and 62 is thereby eliminated, making a stronger door brace.

Spaced in two rows and in two separate sections on the periphery of outer tube 60 are a plurality of holes 66. These holes are of a predetermined spacing to accommodate different heights of door knobs on swinging doors when the door brace is used for blocking a swinging door (as shown in FIG. 2) and to lock the extended tubes of the door brace to a length for blocking of sliding glass doors, as shown in FIG. 3.

Figure 5:
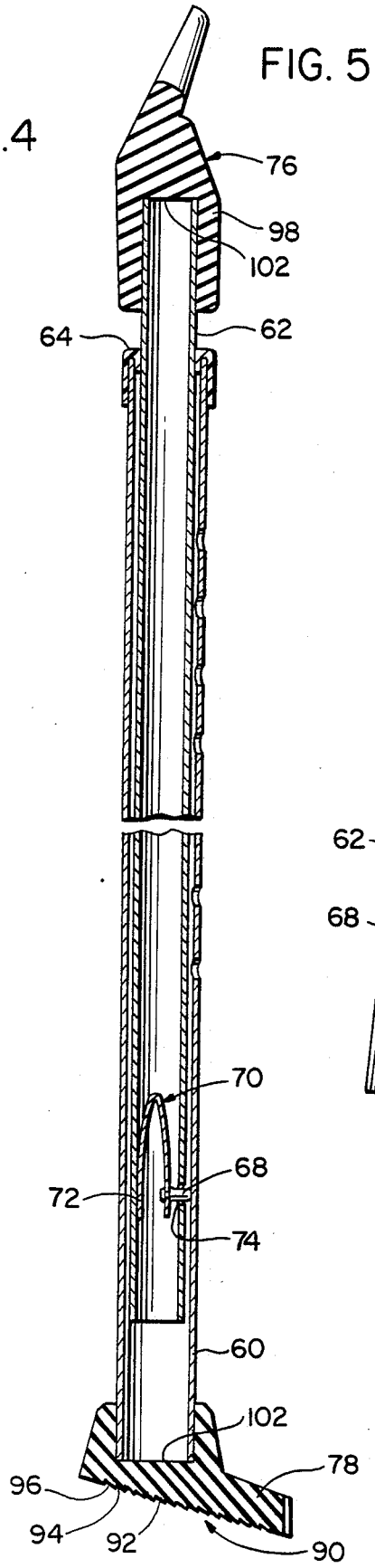
FIG. 5 is a sectional view taken along the line 5—5 of FIG. 4.
Figure 6:
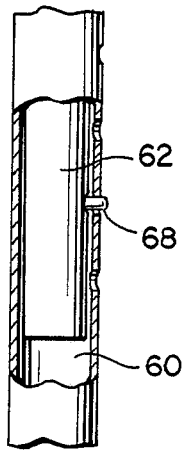
FIG. 6 is a partial sectional view of a section of the door brace in a locked condition.
Figure 7:
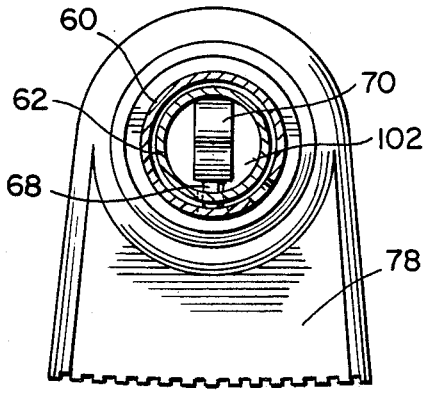
FIG. 7 is a sectional view taken along the line 7—7 of FIG. 4.

A biased pin 68 is shown in a restrained position abutting against outer tube 60 in FIGS. 4 and 5. This position is for shipping purposes only. In the normally extended position of tubes 60 and 62, as evidenced by the phantom lines in FIG. 4, the pin 68 extends through a hole 66, as shown in FIG. 6. The pin is biased by a leaf spring 70 to be forced radially outward from inner tube 62 through hole 74 so that the pin passes through a hole 66 in outer tube 60 to lock the inner and outer tubes at a predetermined overall length. One end 72 of the spring 70 is secured to the interior wall of inner tube 62 so that the pin 68 maintains its extension through opening 74 in the wall of inner tube 62.

When pin 68 is locked in hole 66*a*, the overall length of extension of inner and outer tubes 62 and 60, exclusive of yoke 76 and foot 78, is 27". Successively, the total overall lengths of the extended inner and outer tubes when the pin 68 is locked in the hole 66*b* is 27⅝"; 66*c* is 28¼"; 66*d* is 29⅛". The grouping of holes 66*a*–66*d* is for use in locking a 5' sliding patio glass door 80, as shown in FIG. 3, by placing the tubes 60 and 62 with pin 68 locked in one of holes 66*a*–66*d* and lying the tubes in a track 82 of the sliding glass door. The grouping of holes 66*e*–66*j* is for use in locking a 6' sliding patio glass door 80, as shown in FIG. 3, by placing the tubes 60 and 62 with pin 68 locked in one of holes 66*e*–66*j* and lying the tubes in a track 82 of the sliding glass door. These ten locked positions of the tube 60 and 62, after removal of the yoke 76 and foot 78, have been determined to be universal for a majority of sliding glass doors found in apartments, condominiums, and small homes.

Similarly, by locating the locking pin 68 in holes 66*e*–66*l*, the door brace for a swinging door 84, as shown in FIG. 2, is used by locking the yoke 76 underneath the handle of handle 86 of the door and locking the foot 78 against the floor 88. The overall length of extension of inner and outer tubes 62 and 60 in the extended position, again, exclusive of the yoke and foot for dimensional purposes only, are 66*e*, 33⅛"; 66*f*, 33¾"; 66*g*, 34⅜"; 66*h*, 35"; 66*i*, 35 11/16"; 66*j*, 36¼"; 66*k*, 37½"; and 661, 39".

The door brace of the invention will work on any hinged door, the door knob of which is no higher than 40" from the floor. When the proper hole 66*e*–66*l* setting is determined and pin 68 locked in the appropriate hole, the door brace serves as an effective secondary locking device to help secure the primary entrance doors.

When the rubber yoke 76 and foot 78 are removed from the door brace, the door brace then serves the alternate function of securing a sliding glass door. Holes 66*a*–66*d* in the outer tube 60 are designed to secure pin 68 so that the tubing can be used as a dowel rod in the bottom track of a sliding glass door. These hole configurations are generally effective for 5' sliding glass doors and holes 66*e*–66*j* are generally effective for 6' sliding glass doors.

Every hole in outer tube 60 provides accommodation for the most commonly required door brace and sliding glass door lock-assisting measures. The exact positions of each of the holes 66*a*–66*l* are, therefore, critical for accommodating the majority of hinged and sliding glass doors in apartments, condominium, and small homes.

The connector cuff 64 actually makes the door brace of the invention a more effective locking device. The wobble between the inner and outer tubes 60 and 62 is substantially reduced and prevents a would-be intruder from rocking or bouncing against a hinged door numerous times to actually cause the door brace to walk or move forward. By reducing the movement between the inner and outer tubes, it is impossible to create a harmonic (wobble movement) by pushing on a hinged door.

The foot 78 includes several important features. Initially, the bottom surface 90 of the foot 78 is inclined with respect to the direction of extension of the inner and outer tubes 60 and 62. Additionally, a series of steps 92, which are inclined with respect to the bottom surface 90, aid in gripping the floor when the foot is used in a door brace against a swinging door. The bottom surface 90 is very effective in gripping such floor surfaces as carpet, wood, vinyl, asbestos tile, linoleum, brick, and concrete. The tread pattern formed by the series of steps 92 and the soft rubber compound used in the injection molding process to form the foot 78 provide a strong gripping surface. In each step 92 is a riser portion 94 which extends vertically from surface 90 and which connects to an inclined surface 96 that is at a steeper angle of incline to the inner and outer tubes 60 and 62 than the bottom surface 90. The riser portions 94 and inclined surfaces 96 serve to tightly grip a floor surface when the door brace is used to assist in locking a swinging door.

The yoke 76 is made of soft rubber, which allows for some degree of flexibility in the yoke. When a would-be intruder pushes against the swinging door, the yoke has a slight degree of flexibility and avoids the crumbling problem encountered with brittle door brace yokes made of a plastic or thermoplastic rubber compound, which tend to break when violently pushed. The length of the portion 98 of the yoke which surrounds the inner tube 62 is 1 $\frac{5}{8}$". This length prevents excessive bending of the U-shaped portion 100 to prevent breakage of the yoke by a pushing force.

Washers or metal discs 102 are located at the ends of the tubes 60 and 62 to prevent cutting of the yoke and foot by the ends of the metal tubes. These spacers generally remain with the yoke and foot when the yoke and foot are removed so that the tubes may be extended to lie in the track 82 of the sliding glass door 80.

Figure 8:
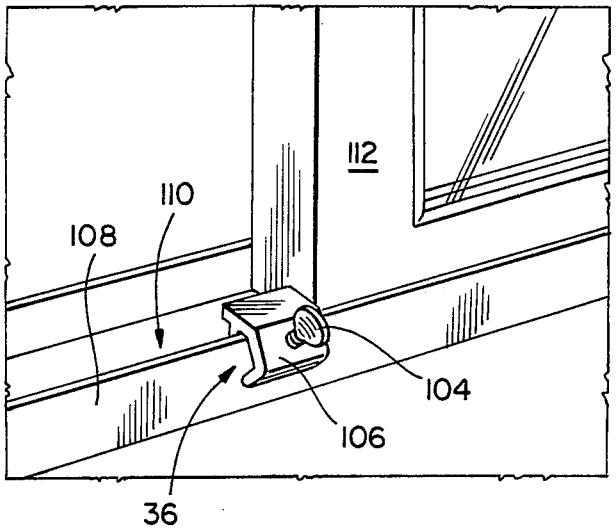
FIG. 8 illustrates a metal window clamp in a locked condition.

In FIG. 8, a single screw metal window clamp 36 is shown having a single thumbscrew 104 which is threaded through one side of the C-shaped portion 106 of the clamp. The metal window clamp is secured to a sidewall 108 of a track 110 for a horizontally sliding aluminum or metal window 112. Alternately, on vertically sliding aluminum windows, the clamp 36 may similarly be located in the track of the window. The clamp may be adjusted along the track of a window to allow varying openings of the windows for ventilation.

Figure 9:
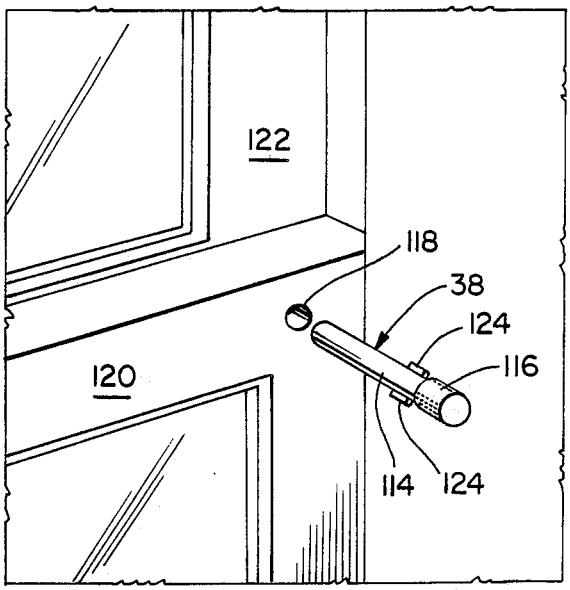
FIG. 9 illustrates a window pin and a wood sash window.

In FIG. 9, window pin 38 is shown having 2$\frac{3}{4}$" shank 114 and $\frac{1}{2}$" head 116. The pin 38 fits within a hole 118 drilled within sliding wood sash windows 120 and 122 so that when the pin 38 is slid into the hole, the Windows 120 and 122 may not move with respect to each other.

Figure 10:
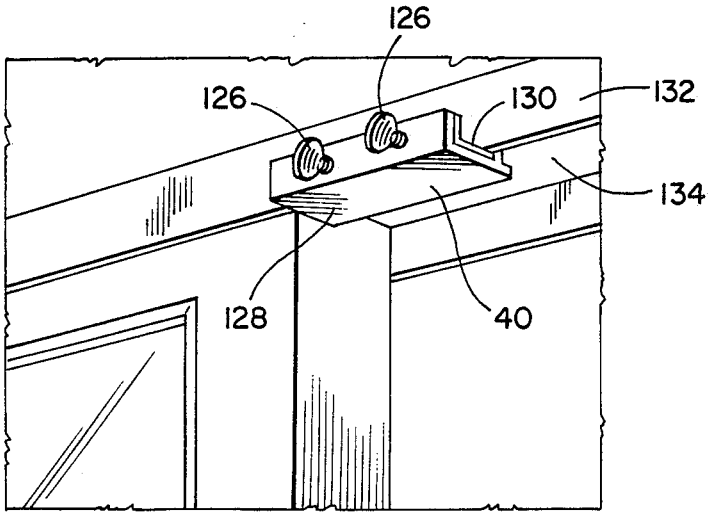
FIG. 10 illustrates a patio door clamp in a locked condition.

In FIG. 10, patio door clamp 40 is shown having two thumbscrews 126 extending through C-shaped metal portion 128. A PVC or rubber insert 130 lines the interior of the C-shaped portion 128 to provide a better grip of the clamp on a sidewall 132 of a sliding glass door track 134. The patio door clamp 40 is shown mounted at the top of a patio door track 134. However, the clamp is also envisioned as being used in the track of the bottom of the sliding glass door.

Each of the door braces 32, window clamps 36, window pins 38, and sliding door clamp 40 are easily removed. Therefore, the lock assisting devices would be easily removed during a fire or other emergency.

Figure 11:
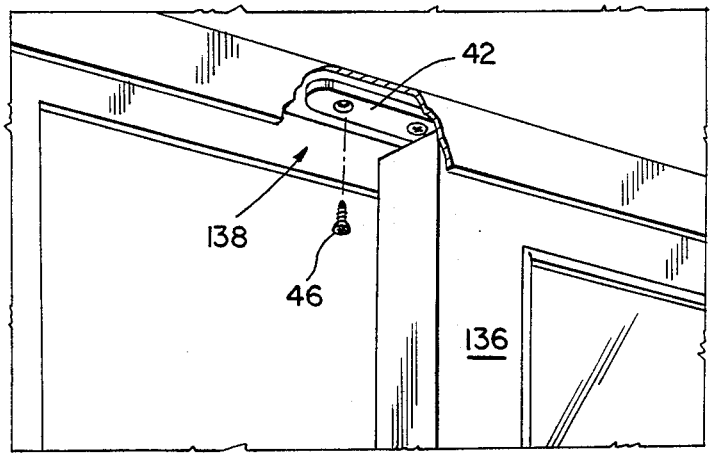
FIG. 11 illustrates an anti-liftout plate above the track of a sliding glass door.
Figure 12:
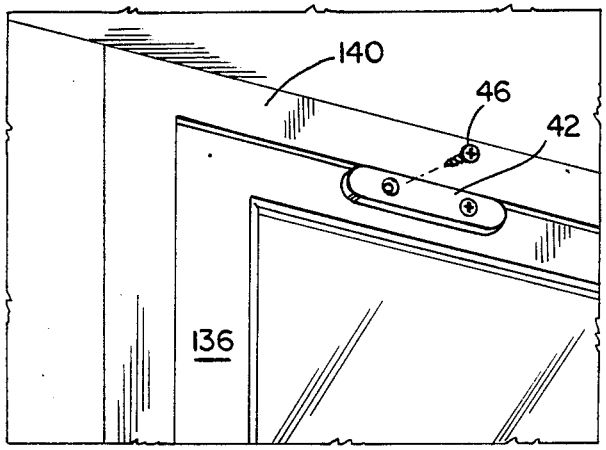
FIG. 12 illustrates an anti-liftout plate attached to a sliding glass door.

In FIGS. 11 and 12, anti-liftout plates 42 are shown secured by screws 46. It is envisioned that if additional thickness is needed for the anti-liftout plates, such as in FIG. 11 to fill the gap between the top edge of the sliding glass door 136 and the top of the track 138, an additional thinner anti-liftout plate 44 shown in FIG. 1 or a second equal-thickness anti-liftout plate 42 may be used to fill the gap between the door 136 and the top of the track 138. The anti-liftout plate 42 prevents a patio door from being lifted into the gap between its top and the top of the track to prevent pivoting outwardly of the bottom of the door and thereby removing the door out of the track. Similarly, in FIG. 12, the anti-liftout plate 42 is secured to the side of the door 136 so as to prevent lifting of the door by engagement of the plate 42 with the bottom edge of sidewall 140 of the track 138. The liftout plate 42 in FIG. 12 achieves the same result as in FIG. 11, but is located in a more conspicuous location, attached to the inside face of the door under the top frame edge.

By the present invention, the combination of components and the number of each component have been determined to provide maximum secondary lock-assisting advantages for an apartment, condominium, or small home. The components chosen to form the kit maximize protection of an individual against forced entry into the home.

Having described the invention, many modifications thereto will become apparent to those skilled in the art to which it pertains, without deviating from the spirit of the invention as defined by the scope of the appended claims.

We claim:

1. A home security protection kit comprising:

a container for housing components of the kit, the components of the kit housed in said container including a window clamp for securing a sliding metal frame window, a window pin for preventing relative movement of an upper portion and a lower portion of a wood sash window, a door clamp for securing a sliding door, and anti-liftout plate for prevent liftout of a sliding door out of a slide track, and a door brace for securing either of a hinged door and a sliding door, said door brace including a single inner tube having two ends, said inner tube having a predetermined outer diameter, a single outer tube having two ends, said outer tube having a predetermined inner diameter greater than said outer diameter of said inner tube, said inner tube being slidably mounted in said outer tube and forming a gap between said inner tube and said outer tube, a connector cuff located atone end of said outer tube and having an inner diameter substantially equal to said outer diameter of said inner tube and less than said inner diameter of said outer tube for filling the gap between said inner tube and said outer tube so as to provide smooth sliding of said inner tube within said outer tube without wobble, a yoke removably mounted on one end of said inner tube for engagement with a handle of a swinging door, said yoke including a recess for receiving said one end of said inner tube in a fixed position, a foot removably mounted on the other end of said outer tube for engagement with the floor spaced from a swinging door, said foot including a recess for receiving said other end of said outer tube in a fixed position, a plurality of holes defined by said outer tube at predetermined distances along said outer tube for locking of said outer tube with respect to said inner tube to produce an overall length of said inner tube and said outer tube suitable for securing a swinging door when the yoke is on the inner tube and the foot is on the outer tube and for securing a sliding door of an approximately five to six foot wide door structure when the yoke is removed from the inner tube and the foot is removed from the outer tube, locking means located within the other end of said inner tube for locking said inner tube relative to said outer tube at a predetermined length for securing a swinging door and at a predetermined length for securing a sliding door of an approximately five to six foot wide door structure, said locking means including a pin protecting through a hole of said inner tube and through one of said plurality of holes of said outer tube to lock said inner tube relative to said outer tube, a first group of said plurality of holes being positioned on said outer tube to lock said inner tube relative to said outer tube by said locking means for securing a hinged door by engagement of said yoke with a handle of the hinged door and engagement of said foot with the floor spaced from the hinged door, and a remainder of said plurality of holes and some of said first group of holes being positioned on said outer tube to lock said inner tube relative to said outer tube by said locking means for preventing sliding of a sliding door of an approximately five to six foot wide door structure after removal of said yoke and said foot and placing of said inner tube and said outer tube nesting on a slide track of a sliding door of an approximately five to six foot wide door structure for engagement of said other end of said outer tube and said one end of said inner tube between a wall and the sliding door.

2. The home security protection kit of claim 1, wherein said container includes a total of two door braces, four window clamps, four window pins, one door clamp, and four anti-liftout plates.

3. The home security protection kit of claim 1, wherein said foot includes a plurality of riser portions and inclined surfaces defining a bottom surface of said foot for gripping a floor surface.

4. The home security protection kit of claim 3, wherein said yoke is made of soft rubber.

5. The home security protection kit of claim 1, wherein said window clamp, said window pin, said door clamp, and said anti-liftout plate are mounted on a backing sheet.

6. The home security protection kit of claim 5, wherein said backing sheet is labelled to describe the mounted window clamp, window pin, door clamp, and anti-liftout plate.

7. A home security protection kit comprising:

a container for housing components of the kit, the components of the kit housed in said container including two door braces extending along a longitudinal axis of said container for each securing one of a hinged door and a sliding door, four window clamps for securing sliding metal frame windows, four window pins for preventing relative movement of an upper portion and a lower portion of a wood sash window, a door clamp for securing a sliding door, and four anti-liftout plates for preventing lifting of a sliding door out of a slide track, and each door brace including a single inner tube having two ends, said inner tube having a predetermined outer diameter, a single outer tube having two ends, said outer tube having a predetermined inner diameter greater than said outer diameter of said inner tube, said inner tube being slidably mounted in said outer tube and forming a gap between said inner tube and said outer tube, a connector cuff located at one end of said outer tube and having an inner diameter substantially equal to said outer diameter of said inner tube and less than said inner diameter of said outer tube for filling the gap between said inner tube and said outer tube so as to provide smooth sliding of said inner tube within said outer tube without wobble, a yoke removably mounted on one end of said inner tube for engagement with a handle of a swinging door, said yoke including a recess for receiving said one end of said inner tube in a fixed position, a foot removably mounted on the other end of said outer tube for engagement with the floor spaced from a swinging door, said foot including a recess for receiving said other end of said outer tube in a fixed position, a plurality of holes defined by said outer tube at predetermined distances along said outer tube for locking of said outer tube with respect to said inner tube to produce an overall length of said inner tube and said outer tube suitable for securing a swinging door when the yoke is on the inner tube and the foot is on the outer tube and for securing a sliding door of an approximately five to six foot wide door structure when the yoke is removed from the inner tube and the foot is removed from the outer tube, locking means located within the other end of said inner tube for locking said inner tube relative to said outer tube at a predetermined length for securing a swinging door and at a predetermined length for securing a sliding door of an approximately five to six foot wide door structure, said locking means including a pin projecting through a hole of said inner tube and through one of said plurality of holes of said outer tube to lock said inner tube relative to said outer tube, a first group of said plurality of holes being positioned on said outer tube to lock said inner tube relative to said outer tube by said locking means for securing a hinged door by engagement of said yoke with a handle of the hinged door and engagement of said foot with the floor spaced from the hinged door, and a remainder of said plurality of holes and some of said first group of holes being positioned on said outer tube to lock said inner tube relative to said outer tube by said locking means for preventing sliding of a sliding door of an approximately five to six foot wide door structure after removal of said yoke and said foot and placing of said inner tube and said outer tube nesting on a slide track of a sliding door of an approximately five to six foot wide door structure for engagement of said other end of said outer tube and said one end of said inner tube between a wall and the sliding door.

8. A door brace for securing a swingable door or preventing sliding of a sliding door, said door brace comprising:

a single inner tube having two ends, said inner tube having a predetermined outer diameter, a single outer tube having two ends, said outer tube having a predetermined inner diameter greater than said outer diameter of said inner tube, said inner tube being slidably mounted in said outer tube and forming a gap between said inner tube and said outer tube, a connector cuff located at one end of said outer tube and having an inner diameter substantially equal to said outer diameter of said inner tube and less than said inner diameter of said outer tube for filling the gap between said inner tube and said outer tube so as to provide smooth sliding of said inner tube within said outer tube without wobble, a yoke removably mounted on one end of said inner tube for engagement with a handle of a swinging door, said yoke including a recess for receiving said one end of said inner tube in a fixed position, a foot removably mounted on the other end of said outer tube for engagement with the floor spaced from a swinging door, said foot including a recess for receiving said other end of said outer tube in a fixed position, a plurality of holes defined by said outer tube at predetermined distances along said outer tube for locking of said outer tube with respect to said inner tube to produce an overall length of said inner tube and said outer tube suitable for securing a swinging door when the yoke is on the inner tube and the foot is on the outer tube and for securing a sliding door of an approximately five to six foot wide door structure when the yoke is removed from the inner tube and the foot is removed from the outer tube, locking means located within the other end of said inner tube for locking said inner tube relative to said outer tube at a predetermined length for securing a swinging door and at a predetermined length for securing a sliding door of an approximately five to six foot wide door structure, said locking means including a pin projecting through a hole of said inner tube and through one of said plurality of holes of said outer tube to lock said inner tube relative to said outer tube, a first group of said plurality of holes being positioned on said outer tube to lock said inner tube relative to said outer tube by said locking means for securing a hinged door by engagement of said yoke with a handle of the hinged door and engagement of said foot with the floor spaced from the hinged door, and a remainder of said plurality of holes and some of said first group of holes being positioned on said outer tube to lock said inner tube relative to said outer tube by said locking means for preventing sliding of a sliding door of an approximately five to six foot wide door structure after removal of said yoke and said foot and placing of said inner tube and said outer tube nesting on a slide track of a sliding door of an approximately five to six foot wide door structure for engagement of said other end of said outer tube and said one end of said inner tube between a wall and the sliding door.

9. The door brace of claim 8, wherein said outer tube includes at least eight holes of said plurality of holes for securing a swinging door and at least ten holes of said plurality of holes for preventing sliding of a sliding door.

10. The door brace of claim 9, wherein said at least eight holes are spaced as a group from said four holes as a group.

11. The door brace of claim 8, wherein said foot includes a plurality of riser portions and inclined surfaces defining a bottom surface of said foot for gripping a floor surface.

12. The door brace of claim 11, wherein said yoke is made of soft rubber.

* * * * *